US008074392B2

(12) United States Patent
Hu

(10) Patent No.: US 8,074,392 B2
(45) Date of Patent: Dec. 13, 2011

(54) TOY RIFLE BACKLASH VIBRATION STRUCTURE

(76) Inventor: Shih-Che Hu, Yung Kang (TW)

( * ) Notice: Subject to any disclaimer, the term of this patent is extended or adjusted under 35 U.S.C. 154(b) by 742 days.

(21) Appl. No.: 12/243,021

(22) Filed: Oct. 1, 2008

(65) Prior Publication Data

US 2009/0127758 A1 May 21, 2009

(30) Foreign Application Priority Data

Nov. 19, 2007 (TW) ..... 96143747 A

(51) Int. Cl.
*F41A 33/06* (2006.01)
*F41B 11/00* (2006.01)

(52) U.S. Cl. ..... 42/54; 124/65; 124/66; 434/18

(58) Field of Classification Search ..... 434/11, 434/18; 42/54, 55, 57, 58, 1.06; 124/65–68, 124/80; 267/167
See application file for complete search history.

(56) References Cited

U.S. PATENT DOCUMENTS

| | | | | |
|---|---|---|---|---|
| 5,261,384 | A * | 11/1993 | Hu | 124/66 |
| 6,553,707 | B1 * | 4/2003 | Tseng | 42/72 |
| 7,694,448 | B2 * | 4/2010 | Iwasawa | 42/54 |
| 7,770,504 | B2 * | 8/2010 | Tippmann et al. | 89/7 |
| 7,946,283 | B2 * | 5/2011 | Lee et al. | 124/67 |
| 7,963,281 | B2 * | 6/2011 | Pong | 124/67 |
| 2002/0170551 | A1 * | 11/2002 | Kotsiopoulos et al. | 124/54 |

* cited by examiner

*Primary Examiner* — Kurt Fernstrom
(74) *Attorney, Agent, or Firm* — Pro-Techtor Int'l Services

(57) ABSTRACT

A toy rifle (air soft rifle, BB-rifle) backlash vibration structure is disclosed formed of a receiver extension, a weight, a reaction spring and a buttcap spacer. The weight has a front extension inserted through the frame of the toy riffle and connected to the rear end of the piston spring at the rear side of the piston so that the component parts of the backlash vibration structure does not touch the piston during movement of the piston. The buttcap spacer is detachably fastened to the rear side of the receiver extension and mounted with an adjustment screw rod that is rotatable relative to the buttcap spacer to adjust the level of the backlash vibration from zero to the maximum.

6 Claims, 7 Drawing Sheets

TOY RIFLE BACKLASH VIBRATION STRUCTURE

BACKGROUND OF THE INVENTION

1. Field of the Invention

The present invention relates to a toy rifle (air soft rifle/BB-rifle) and more particularly, to a toy riffle backlash vibration structure that allows adjustment of the backlash vibration from zero to the maximum level.

2. Description of the Related Art

To simulation of a real automatic rifle, a toy rifle (air soft rifle/BB-rifle) may be provided with a backlash vibration structure. Taiwan Patent Publication No. 200708712 discloses a similar design. However, this design is still not satisfactory in function.

FIG. 1 illustrates a backlash vibration structure a' installed in a toy riffle. As illustrated, the backlash vibration structure a' is arranged at the rear side in axial alignment with the piston 10 in the piston-cylinder mechanism b', comprising a receiver extension 20, a weight 30, a reaction spring 40, and a buttcap spacer 50 The receiver extension 20 is connected to the rear side of the lower receiver c' that accommodates the piston-cylinder mechanism b'. The weight 30 and the reaction spring 40 are mounted inside the receiver extension 20. The reaction spring 40 is connected between the weight 30 and the buttcap spacer 50. The piston 101 has its rear side mounted with a piston spring 101. The piston spring 101 has its one end received in the piston 10, and its other end stopped against an inside wall of the lower receiver c'. Further, a connection rod 60 is movably inserted through the lower receiver c' and connected between the piston spring 101 and the weight 30. The toy riffle further comprises a transmission mechanism d', a trigger c' and a bullet pusher f'. When pressed the trigger e', the transmission mechanism d'is forced to move the piston-cylinder mechanism b', causing the bullet pusher f' to push the bullet into the firing position for striking by (the firing pin of) the piston 10. During movement of the transmission mechanism d', the piston 10 is moved backwards, and the connection rod 60 is moved with the piston 10 to force the weight 30 against the reaction spring 40 (see FIG. 2). When over the compression limit of the reaction spring 40, the reaction spring 40 forces the weight 39 forwards, and the piston 10 is moved forwards in a rush to shoot the bullet (see also FIG. 1). During forward movement of the weight 30, a reactive force is produced, causing a backlash vibration.

According to the aforesaid design, the connection rod 60 is connected between the piston spring 101 and the weight 30 and has its front end suspending in the piston 10, the inside wall of the piston 10 will strike the front end of the connection rod 60 during backward movement of the piston 10, and the front end of the connection rod 60 will strike the inside wall of the piston 10 during forward movement of the weight 30. Therefore, the piston 10 wears quickly with use. Further, the pressure of the backlash is determined subject to the weight of the weight 30 and the spring force of the reaction spring 40 and the piston spring 101. However, because the weight of the weight 30 is fixed, and the spring force of the reaction spring 40 and the piston spring 101 will be gradually reducing after a long use. In consequence, the backlash vibration will become small and not adjustable after a long use of the toy riffle. Therefore, an improvement in this regard is necessary.

SUMMARY OF THE INVENTION

The present invention has been accomplished under the circumstances in view. It is the main object of the present invention to provide a toy rifle (air soft rifle/BB-rifle) backlash vibration structure that allows adjustment of the level of the backlash vibration. It is another object of the present invention to provide a toy riffle backlash vibration structure that facilitates replacement of the component parts. It is still another object of the present invention to provide a toy riffle backlash vibration structure that greatly prolongs the working life of the piston.

To achieve these and other objects of the present invention, the backlash vibration structure is installed in a rear side of a frame of a toy riffle in axial alignment with a piston in a piston-cylinder mechanism, comprising a receiver extension affixed to a rear side of the frame, a weight mounted in the receiver extension and axially movable along the receiver extension relative to the frame, a buttcap spacer detachably fastened to a rear side of the receiver extension, and a reaction spring connected between the weight and the buttcap spacer. The buttcap spacer is detachably fastened to a rear side of the receiver extension and mounted with an adjustment rod. The adjustment rod is fastened to the buttcap spacer and rotatable forwards and backwards relative to the buttcap spacer between a front limit position where the adjustment screw rod is stopped against a rear side of the weight and a rear limit position where the adjustment screw rod is spaced from the weight at a predetermined distance.

According to another aspect of the present invention, the reaction spring is sleeved onto the adjustment rod and stopped between the weight and the buttcap spacer.

According to still another aspect of the present invention, the weight comprises a base mounted in and movable along the receiver extension, a front tip coupled to the rear end of the piston spring, and a front extension inserted through the frame of the toy rifle and connected between the base and the front tip and inserted through the frame.

DETAILED DESCRIPTION OF THE PREFERRED EMBODIMENT

Figure 1:
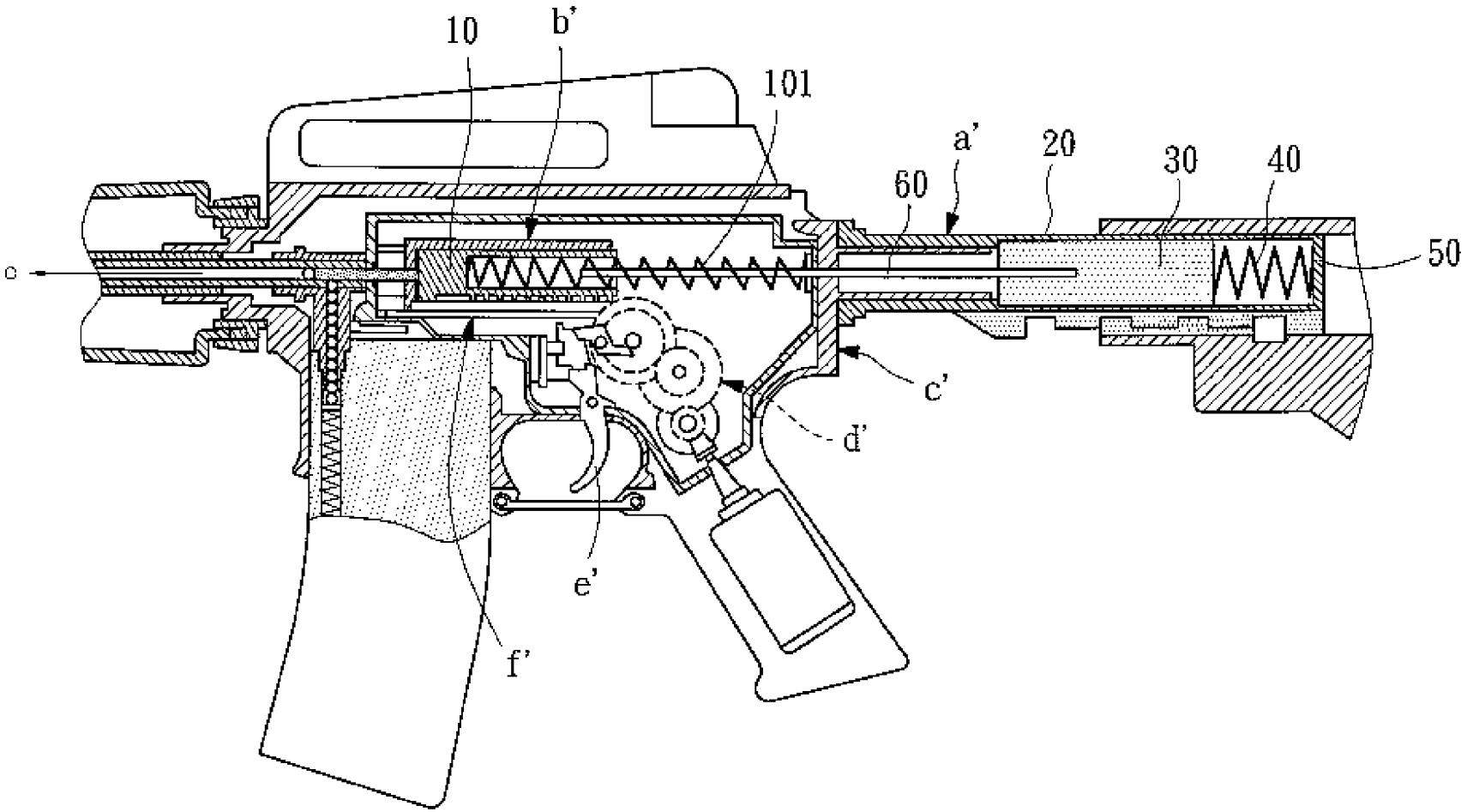
FIG. 1 (PRIOR ART)
FIG. 1 is a schematic drawing of a part of a toy rifle (air soft rifle/BB-rifle) according to the prior art, showing the arrangement of the backlash vibration structure and firing of a bullet.
Figure 2:
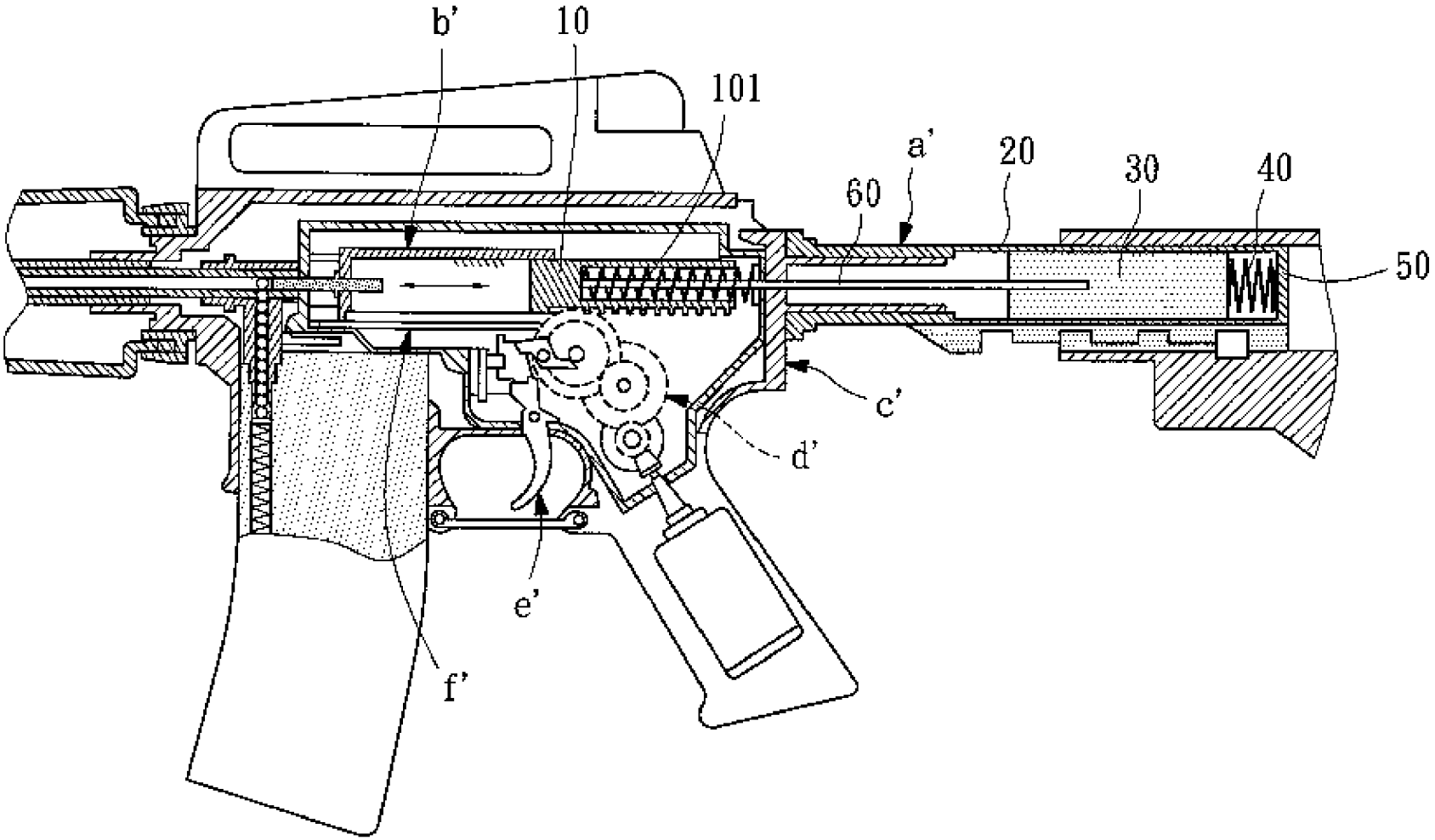
FIG. 2 (PRIOR ART)
FIG. 2 corresponds to FIG. 1, showing the piston moved backwards and the reaction spring compressed.
Figure 3:
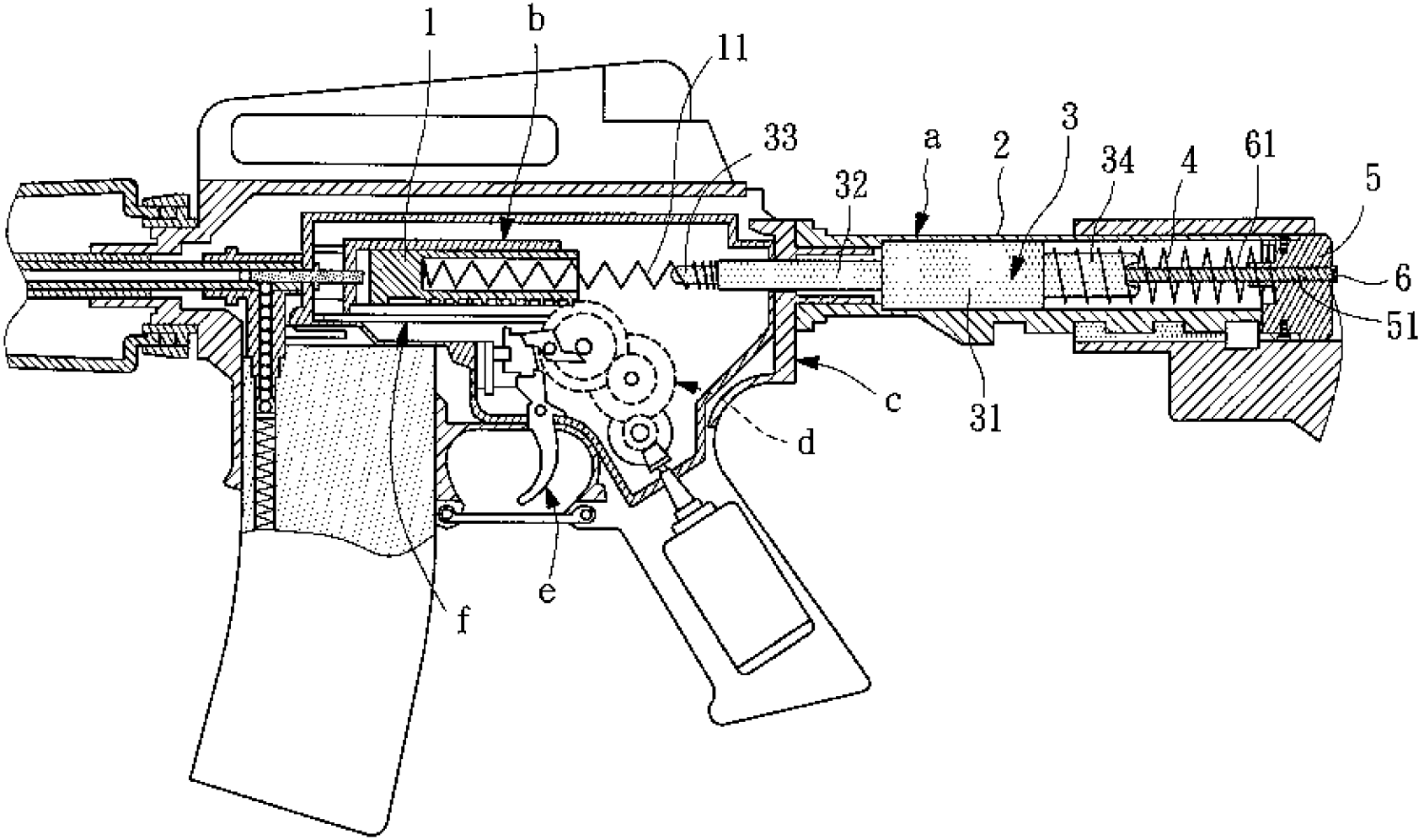
FIG. 3 is a schematic drawing showing a backlash vibration structure arranged in a toy rifle (air soft rifle/BB-rifle) according to the present invention.

Referring to FIG. 3, a backlash vibration structure a is arranged at the rear side of a toy riffle in axial alignment with a piston 1 in a piston-cylinder mechanism b. The piston 1 has a piston spring 11 mounted in its rear side. The piston spring 11 has its one end received in the rear side of the piston 1. The toy riffle further comprises a transmission mechanism d, a trigger e and a bullet pusher f arranged under the piston-cylinder mechanism b. When pressed the trigger e, the transmission mechanism d is forced to move the piston-cylinder mechanism b, causing the bullet pusher f to push the bullet into the firing position for striking by (the firing pin of) the piston 1.

Figure 4:
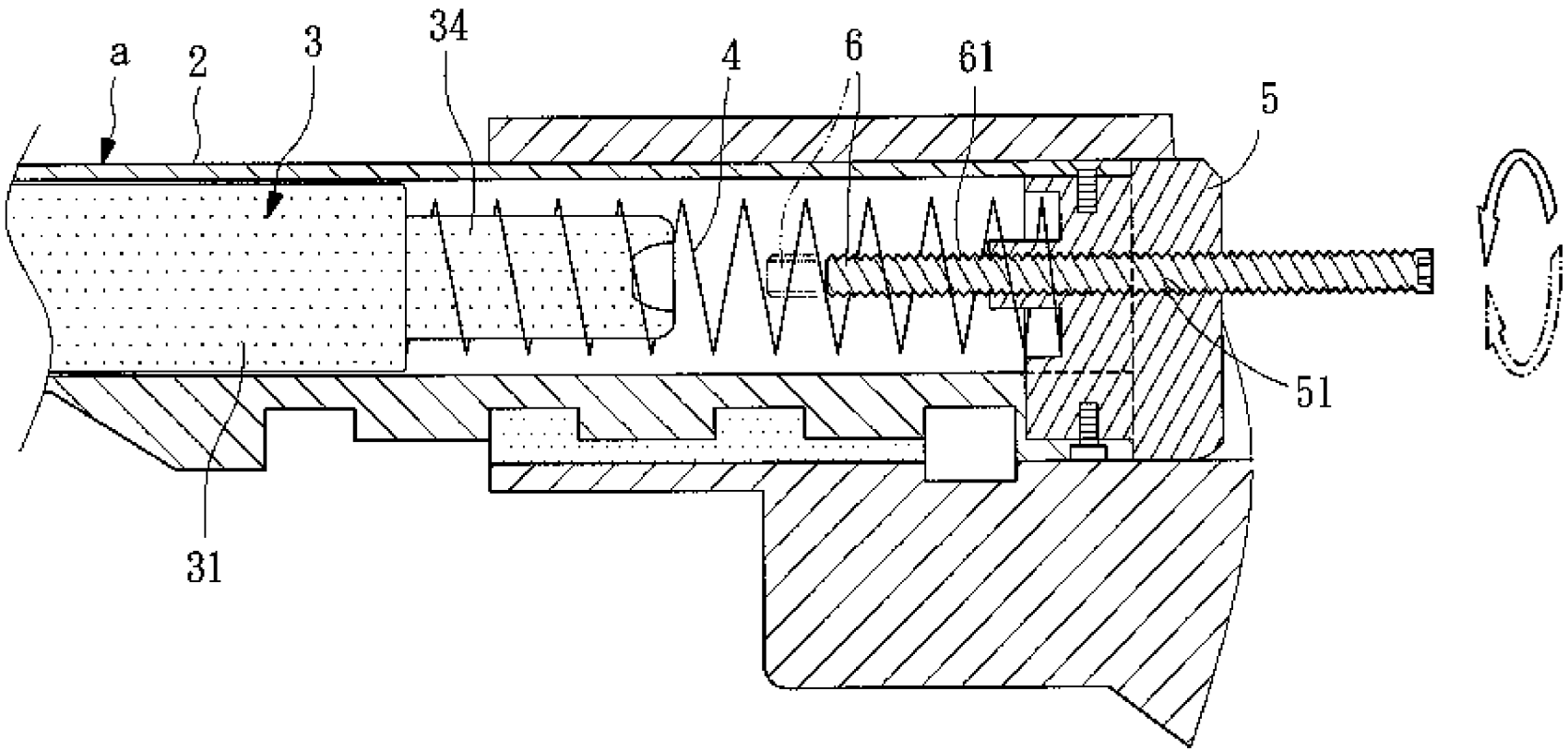
FIG. 4 is a schematic sectional view of a part of the present invention, showing the adjustment rod rotated relative to the buttcap spacer.

The backlash vibration structure a comprises a receiver extension 2, a weight 3, a reaction spring 4, and a buttcap spacer 5. The receiver extension 2 is connected to the rear side of the frame c of the toy riffle that accommodates the piston-cylinder mechanism b. The weight 3, the reaction spring 4 and the buttcap spacer 5 are mounted in the rear side of the receiver extension 2. The reaction spring 4 is connected between the weight 3 and the buttcap spacer 5. The buttcap spacer 5 is detachably fastened to the rear side of the receiver extension 2 (by, for example, a screw joint). An adjustment rod 6 is fastened to the buttcap spacer 5 and rotatable relative to the buttcap spacer 5 (see FIG. 4). The adjustment rod 6 can be rotated forwards to have its front end stopped against the rear end of the weight 3 (see FIG. 5). Furthers the buttcap spacer 5 has a screw hole 51. The adjustment rod 61 has an outer thread 61 threaded into the screw hole 51 and inserted through the reaction spring 4.

The weight 3 is inserted through the frame c with its front end stopped against the rear end of the piston spring 11. The weight 3 comprises a cylindrical base 31, a front tip 33, a front extension 32 axially connected between the cylindrical base 31 and the front tip 33, and a rear extension 34. The cylindrical base 31 is received in the receiver extension 2. The front extension 32 is inserted through the frame c of the toy riffle The front tip 33 is fastened to the rear end of the piston spring 11 opposite to the piston 1. The rear extension 34 extends axially backwardly from the rear side of the cylindrical base 31 opposite to the front extension 32 to hold the front end of the reaction spring 4.

Figure 6:
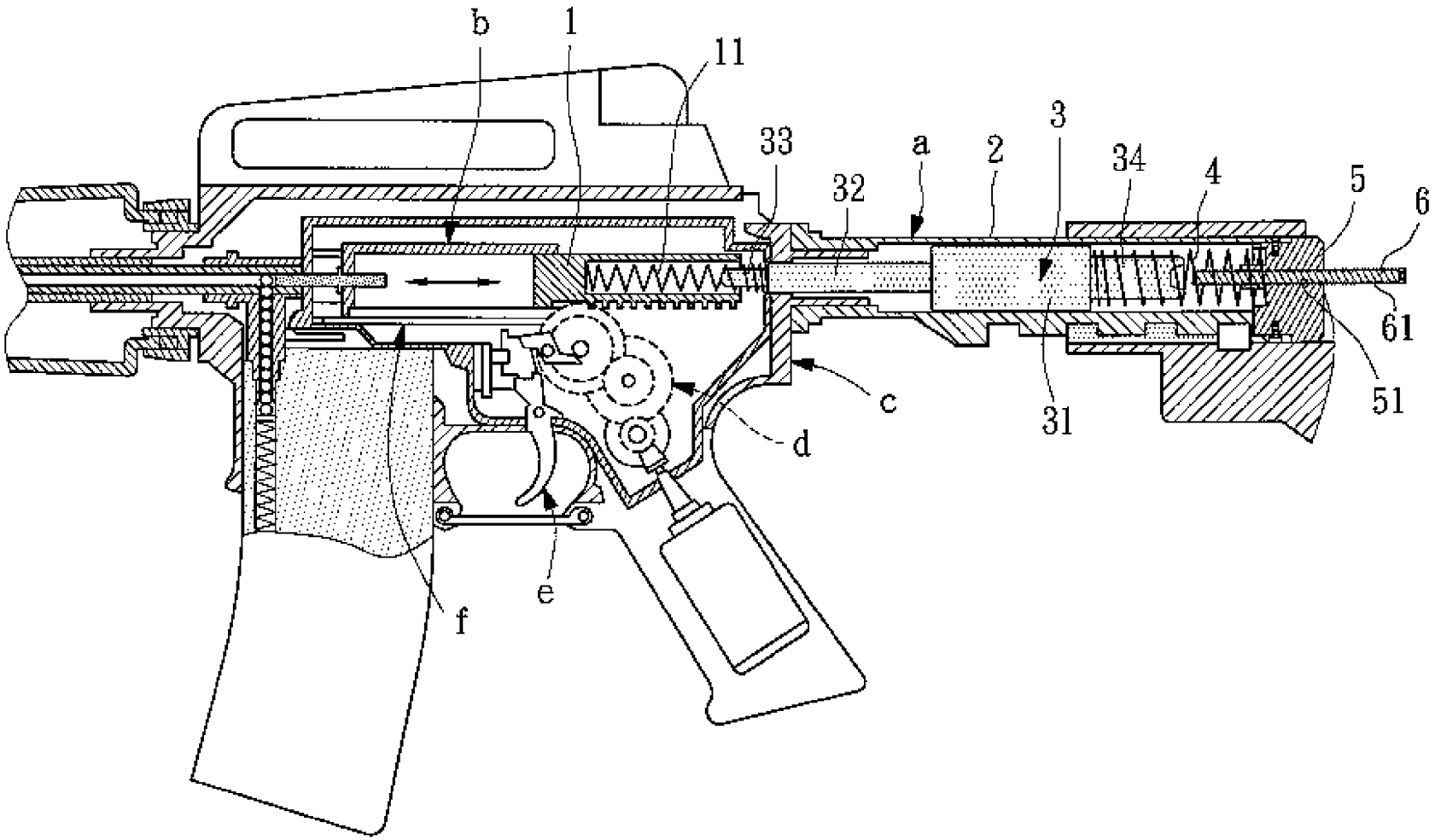
FIG. 6 is a schematic drawing of the backlash vibration structure according to the present invention, showing the piston moved backwards and the adjustment rod spaced from the weight at a distance.
Figure 7:
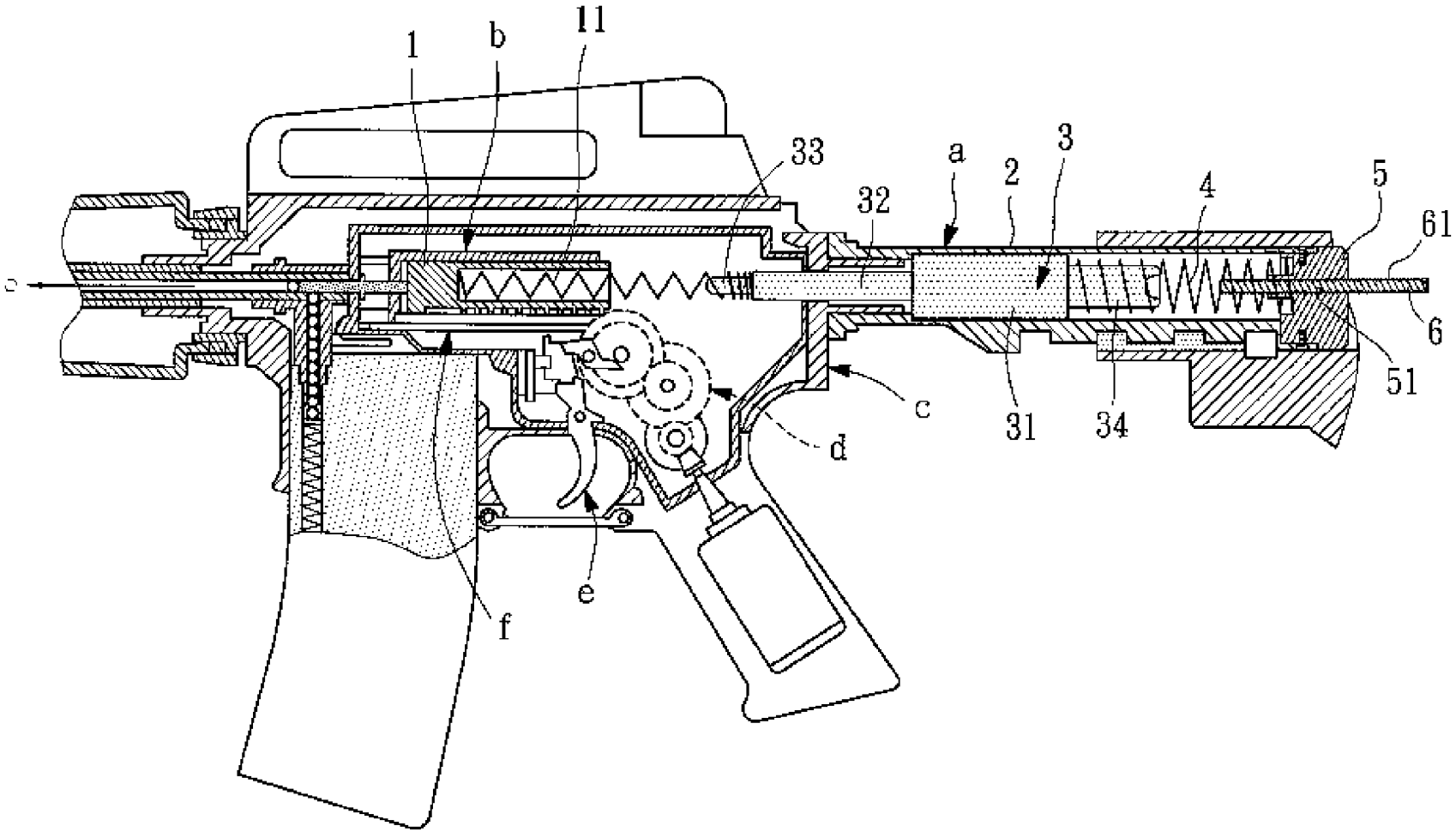
FIG. 7 is a schematic drawing of the present invention, showing the piston moved forwards and a bullet fired.

When pressed the trigger e, the transmission mechanism d is forced to move the piston 1 backwards (see FIG. 6). At this time, the weight 3 is forced backwards by the piston spring 11 to compress the reaction spring 4. When over the compression limit, the reaction spring 4 forces the weight 3 forwards, and the piston 1 is forced forwards by the piston spring 11 to strike the bullet, causing shooting of the bullet (see FIG. 7). During forward movement of the weight 3, a backlash vibration is produced, simulating a backlash vibration of a real rifle during firing of a bullet. Further, the user can rotate the adjustment rod 6 (see FIG. 4) forwards to shorten the distance between the front end of the adjustment rod 6 and the weight 3, i.e., to shorten the displacement range of the weight 3, thereby reducing the reaction spring force of the reaction spring 4, and therefore the backlash vibration is relatively reduced. On the contrary, when rotating the adjustment rod 6 backwards to increase the distance between the front end of the adjustment rod 6 and the weight 3, the displacement range of the weight 3 is relatively increased, and therefore the level of the backlash vibration is relatively increased.

Figure 5:
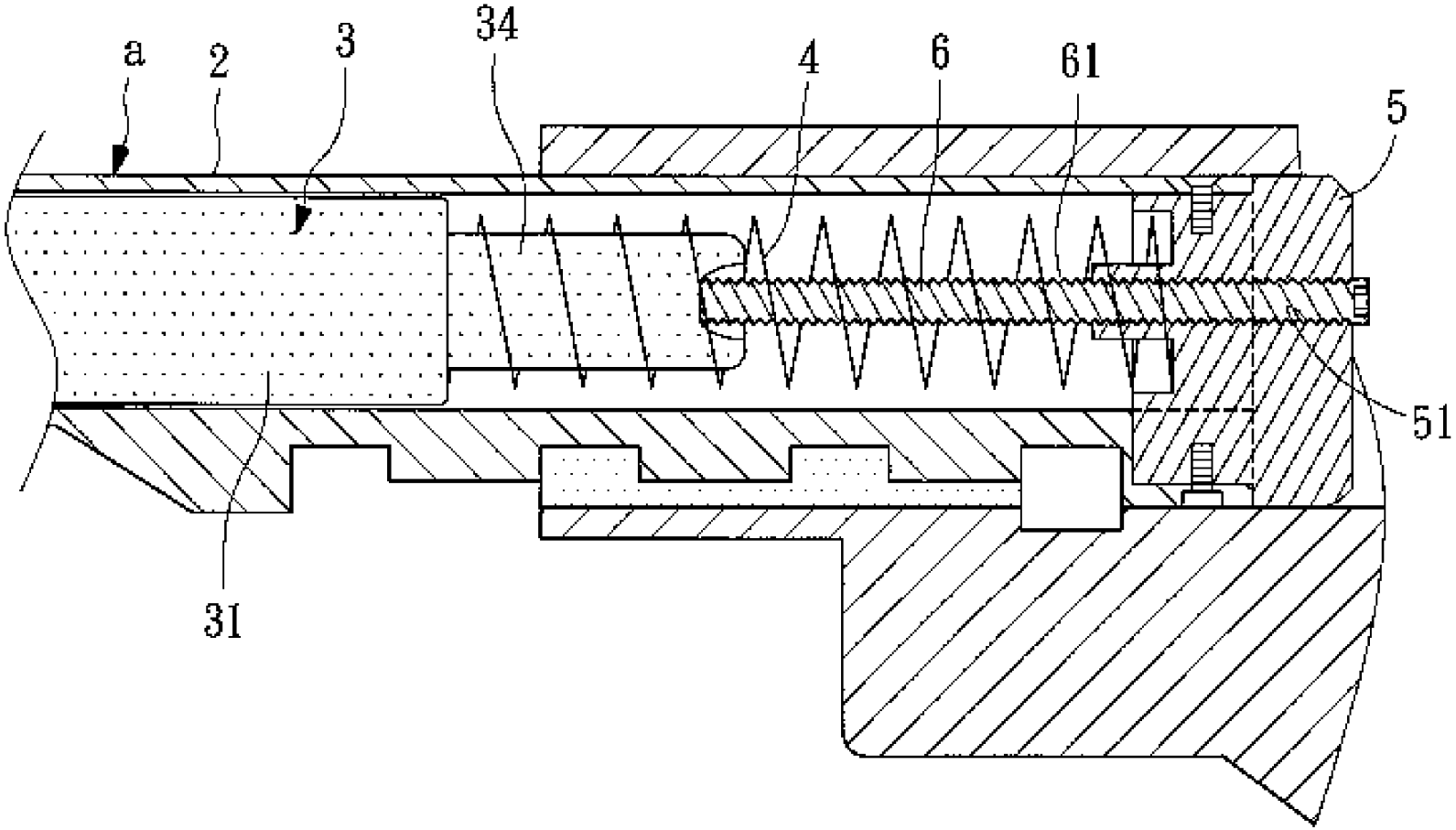
FIG. 5 corresponds to FIG. 4, showing the adjustment rod stopped against the rear side of the weight.

Furthers as shown in FIGS. 3 and 5, when the adjustment rod 6 is rotated to the position where the front end of the adjustment rod 6 is stopped against the free end of the rear extension 34 of the weight 3, the weight 3 is prohibited from backward displacement, and the reaction spring 4 does no work, and therefore no any backlash vibration will be produced upon firing of one bullet. This zero backlash vibration mode fits the requirement for high shooting precision. Further, when a component part replacement is necessary, the buttcap spacer 5 can be removed from the rear side of the receiver extension Z to facilitate the component part replacement work. Further, by means of changing the gravity weight of the weight 3 or the spring strength of the reaction spring 4, the backlash vibration is relatively changed.

Further, because the front end of the weight 3 is directly connected with the rear end of the piston spring 11 without any other connection means, the invention avoids piston 1 damage, and therefore the working life of the piston 1 is prolonged. Further, the weight 3 has a relatively greater size and gravity weight when compared to the prior art design, and therefore the invention can provide a relatively greater backlash vibration sufficient to compensate for the pressure loss due to the effect of the spring force applied by the piston spring 11 to the weight 3.

Although a particular embodiment of the invention has been described in detail for purposes of illustration, various modifications and enhancements may be made without departing from the spirit and scope of the invention.

What the invention claimed is:

1. A backlash vibration structure installed in a rear side of a frame of a toy rifle in axial alignment with a piston in a piston-cylinder mechanism, comprising a receiver extension affixed to a rear side of said frame, a weight mounted in said receiver extension and axially movable along said receiver extension relative to said frame, a buttcap spacer detachably fastened to a rear side of said receiver extensions and a reaction spring connected between said weight and said buttcap spacer, wherein said buttcap spacer is detachably fastened to a rear side of said receiver extension and mounted with an adjustment rod; said adjustment rod being fastened to said buttcap spacer and rotatable forwards and backwards relative to said buttcap spacer between a front limit position where said adjustment screw rod is stopped against a rear side of said weight and a rear limit position where said adjustment screw rod is spaced from said weight at a predetermined distance.

2. The backlash vibration structure as claimed in claim 1, wherein said buttcap spacer has a screw hole extending through front and rear sides thereof; said adjustment rod is a screw rod threaded into said screw hole.

3. The backlash vibration structure as claimed in claim 2, wherein said reaction spring is sleeved onto said adjustment rod and stopped between said weight and said buttcap spacer.

4. The backlash vibration structure as claimed in claim 3, wherein said weight has a front side stopped against a rear end of said piston spring.

5. The backlash vibration structure as claimed in claim 4, wherein said weight comprises a front tip coupled to the rear end of said piston spring.

6. The backlash vibration structure as claimed in claim 5, wherein said weight further comprises a base mounted in and movable along said receiver extension, and a front extension connected between said base and said front tip and inserted through said frame.

* * * * *